US010531532B1

(12) United States Patent
Fang et al.

(10) Patent No.: US 10,531,532 B1
(45) Date of Patent: Jan. 7, 2020

(54) SETTING CURRENT ERROR REDUCTION FOR LIGHT-EMITTING DIODE DRIVER CIRCUITS

(71) Applicant: Eaton Intelligent Power Limited, Dublin (IE)

(72) Inventors: Liang Fang, Peachtree City, GA (US); Brian Soderholm, Peachtree City, GA (US); James Moan, Peachtree City, GA (US); Satya Kishan Ungarala, Peachtree City, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/031,878

(22) Filed: Jul. 10, 2018

(51) Int. Cl.
*H05B 33/08* (2006.01)
*G05F 1/12* (2006.01)

(52) U.S. Cl.
CPC ..... *H05B 33/0848* (2013.01); *G05F 1/12* (2013.01); *H05B 33/0809* (2013.01)

(58) Field of Classification Search
CPC .... H05B 33/0848; H05B 33/0809; G05F 1/12
See application file for complete search history.

(56) References Cited

U.S. PATENT DOCUMENTS 9,651,632 B1 * 5/2017 Knapp ..... G01R 31/44
9,887,614 B1 * 2/2018 Horsky ..... H02M 1/08
2008/0218100 A1 * 9/2008 Parikh ..... H05B 33/0815 315/306
2008/0278092 A1 * 11/2008 Lys ..... H05B 33/0815 315/247
2012/0187845 A1 * 7/2012 Saes ..... H05B 33/0818 315/113
2012/0262082 A1 * 10/2012 Esaki ..... H05B 33/0848 315/224
2013/0038241 A1 * 2/2013 Johannessen ..... H05B 33/0869 315/294
2013/0147358 A1 * 6/2013 Kotowski ..... H05B 33/0818 315/122
2014/0035465 A1 * 2/2014 Raj ..... H05B 33/0869 315/151
2014/0225529 A1 * 8/2014 Beczkowski ..... H05B 33/0866 315/297
2015/0022110 A1 * 1/2015 Sisto ..... H05B 33/0866 315/210
2015/0195888 A1 * 7/2015 Szczerba ..... H05B 37/0245 315/307

(Continued)

*Primary Examiner* — Renan Luque
(74) *Attorney, Agent, or Firm* — King & Spalding LLP

(57) ABSTRACT

A light fixture can include a lighting circuit comprising at least one light source and at least one discrete component. The light fixture can also include a power supply coupled to the lighting circuit, where the power supply provides a setting current to the at least one light source. The light fixture can further include a sensor that measures the setting current flowing to the at least one light source. The light fixture can also include a controller coupled to the power supply and the sensor, where the controller provides, in real time, a setting current correction signal to the power supply to adjust the setting current delivered to the at least one light source. The setting current correction signal can be calibrated to an actual value of the at least one discrete component of the lighting circuit.

19 Claims, 5 Drawing Sheets

(56) References Cited

U.S. PATENT DOCUMENTS

| | | | | |
|---|---|---|---|---|
| 2015/0296598 | A1* | 10/2015 | Haid | H05B 37/0272 315/291 |
| 2018/0255614 | A1* | 9/2018 | Sewell | H05B 33/0815 |

* cited by examiner

SETTING CURRENT ERROR REDUCTION FOR LIGHT-EMITTING DIODE DRIVER CIRCUITS

TECHNICAL FIELD

The present disclosure relates generally to light fixtures, and more particularly to systems, methods, and devices for reducing setting current error in light-emitting diode (LED) driver circuits.

BACKGROUND

Power sources (e.g., LED drivers) for many lighting circuits are designed to supply power to light sources (e.g., LEDs) across a range of currents. For example, a programmable LED driver can provide setting currents between 200 mA and 1500 mA to one or more light sources. To keep costs low, many of these power sources use a number of discrete components (e.g., resistors, capacitors, inductors) that can each have a range of errors around an empirical value for that component.

SUMMARY

In general, in one aspect, the disclosure relates to a light fixture that includes a lighting circuit having at least one light source and at least one discrete component. The light fixture can also include a power supply coupled to the lighting circuit, where the power supply provides a setting current to the at least one light source. The light fixture can further include a sensor that measures the setting current flowing to the at least one light source. The light fixture can also include a controller coupled to the power supply and the sensor, where the controller provides, in real time, a setting current correction signal to the power supply to adjust the setting current delivered to the at least one light source. The setting current correction signal can be calibrated to an actual value of the at least one discrete component of the lighting circuit. The setting current correction signal can be derived from measurements made by the sensor relative to corresponding unaltered setting currents generated by the power supply.

In another aspect, the disclosure can generally relate to a controller for a light fixture that includes a control engine. The control engine can be configured to receive notification as to a target setting current to flow through at least one light source of the light fixture. The control engine can also be configured to determine, in real time and based on a setting current correction curve, an altered setting current level. The control engine can further be configured to send, in real time, a setting current correction signal to a power supply, where the power supply generates and delivers the altered setting current level to the at least one light source, where the altered setting current level is substantially similar to the target setting current level. The setting current correction curve corrects for actual values of discrete components of the light fixture.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1:
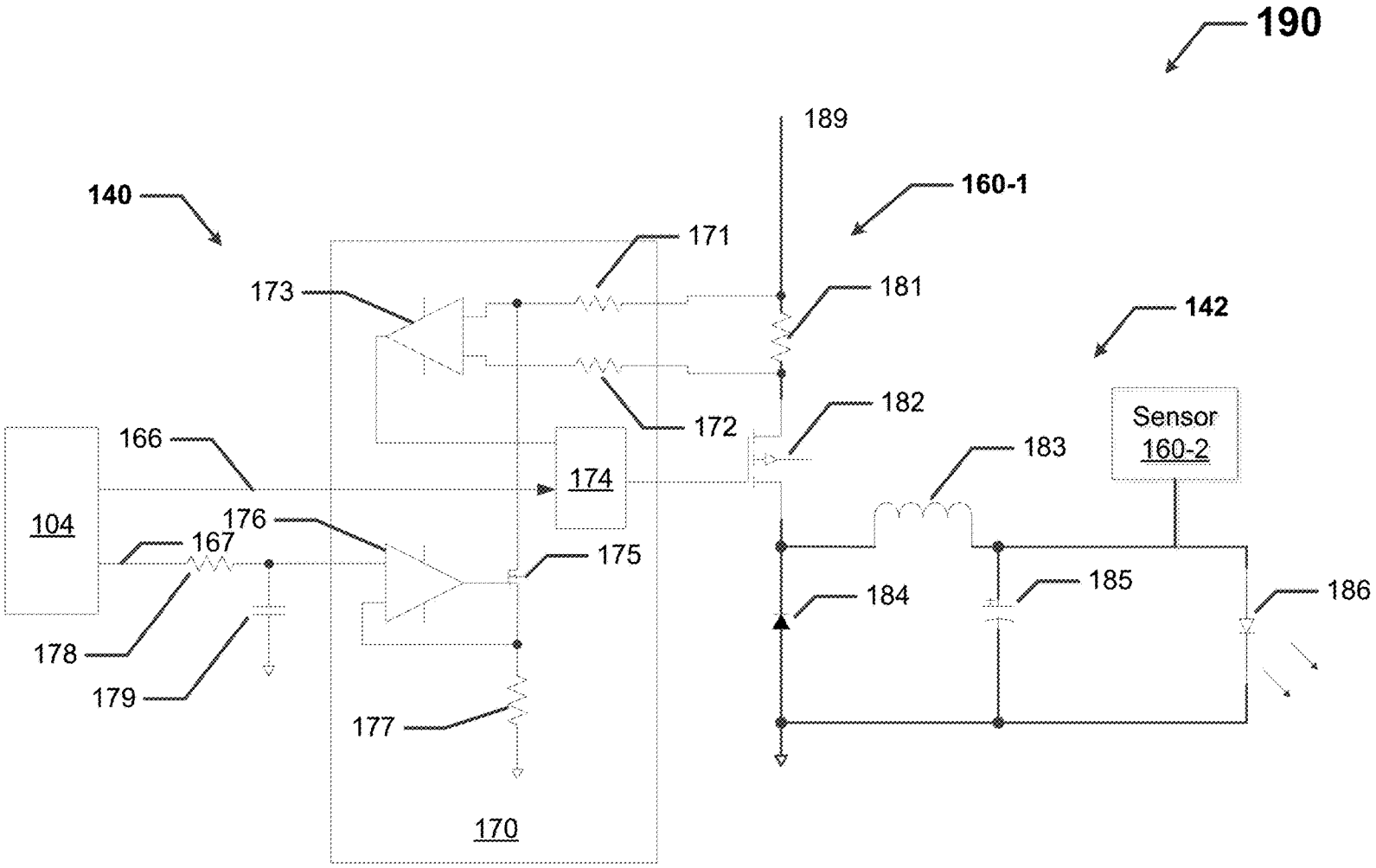
FIG. 1 shows a circuit diagram of a portion of a light fixture in accordance with certain example embodiments.

In general, example embodiments provide systems, methods, and devices for reducing setting current error in LED driver circuits. Example embodiments for reducing setting current error in LED driver circuits provide a number of benefits. Such benefits can include, but are not limited to, increased reliability of a light fixture or a light fixture system, reduced power consumption, longer useful life of light sources, more consistent and predictable light output of light sources, and compliance with industry standards that apply to light fixtures located in certain environments.

Light fixtures that include example embodiments can be located in one or more of any of a number of environments. Examples of such environments can include, but are not limited to, indoors, outdoors, office space, a manufacturing plant, a warehouse, and a storage facility that is either climate-controlled or non-climate-controlled. In some cases, the example embodiments discussed herein can be used in any type of hazardous environment, including but not limited to an airplane hangar, a drilling rig (as for oil, gas, or water), a production rig (as for oil or gas), a refinery, a chemical plant, a power plant, a mining operation, a wastewater treatment facility, and a steel mill.

The example light fixtures that include example embodiments can be made of one or more of a number of suitable materials to allow the light fixture and/or other associated components of a system to meet certain standards and/or regulations while also maintaining durability in light of the one or more conditions under which the light fixtures and/or other associated components of the light fixture can be exposed. Examples of such materials can include, but are not limited to, aluminum, stainless steel, fiberglass, glass, plastic, ceramic, and rubber.

Example light fixtures (or portions thereof) that include example embodiments described herein can be made from a single piece (as from a mold, injection mold, die cast, or extrusion process). In addition, or in the alternative, light fixtures that include example embodiments can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, snap fittings, and slotted fittings. One or more pieces that are mechanically coupled to each other can be coupled to each other in one or more of a number of ways, including but not limited to fixedly, hingedly, removeably, slidably, and threadably.

In the foregoing figures showing example embodiments of reducing setting current error in LED driver circuits, one or more of the components shown may be omitted, repeated, and/or substituted. Accordingly, example embodiments of reducing setting current error in LED driver circuits should not be considered limited to the specific arrangements of components shown in any of the figures. For example, features shown in one or more figures or described with respect to one embodiment can be applied to another embodiment associated with a different figure or description.

In certain example embodiments, light fixtures that include example embodiments are subject to meeting certain standards and/or requirements. For example, the National Electric Code (NEC), the National Electrical Manufacturers Association (NEMA), the International Electrotechnical Commission (IEC), the Federal Communication Commission (FCC), Underwriters Laboratories (UL), and the Institute of Electrical and Electronics Engineers (IEEE) set standards as to electrical enclosures, wiring, and electrical connections. Use of example embodiments described herein meet (and/or allow a corresponding device to meet) such standards when applicable.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number, and corresponding components in other figures have the identical last two digits.

In addition, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of reducing setting current error in LED driver circuits will be described more fully hereinafter with reference to the accompanying drawings, in which example embodiments of reducing setting current error in LED driver circuits are shown. Reducing setting current error in LED driver circuits may, however, be embodied in many different forms and should not be construed as limited to the example embodiments set forth herein. Rather, these example embodiments are provided so that this disclosure will be thorough and complete, and will fully convey the scope of reducing setting current error in LED driver circuits to those of ordinary skill in the art. Like, but not necessarily the same, elements (also sometimes called components) in the various figures are denoted by like reference numerals for consistency.

Terms such as "first", "second", "above", "below", "distal", "proximal", "end", "top", "bottom", "side", and "within" are used merely to distinguish one component (or part of a component or state of a component) from another. Such terms are not meant to denote a preference or a particular orientation, and are not meant to limit embodiments of reducing setting current error in LED driver circuits. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a circuit diagram of a portion of a light fixture 190 in accordance with certain example embodiments. The portion of the light fixture 190 of FIG. 1 can have one or more components and/or groups of components arranged in any of a number of configurations. For example, the portion of the light fixture 190 of FIG. 1 includes two sensors (sensor 160-1 and sensor 160-2), a power supply 140 (also called a driver), a controller 104, and a lighting circuit 142. The sensor 160-1 in this example includes a resistor 181 across which a voltage (a type of parameter) is delivered to the power supply 140. The sensor 160-2 is used to measure current (another type of parameter) flowing to the LEDs 186. The sensor 160-2 can include one or more of a number of components (e.g., a current transformer, an ammeter) to measure the current flowing to the LEDs 186. In this case, the sensor 160-2 can be temporary, used during manufacturing of the light fixture 190 to implement a version of the example embodiments described herein. In general, a sensor (e.g., sensor 160-1, sensor 160-2) can have any of a number of components that measure one or more of any of a number of parameters (e.g., an amount of ambient light, a current, a temperature).

The lighting circuit 142 in this case includes an inductor 183, a diode 184, a capacitor 185, and a LED 186. The lighting circuit 142 can include multiples of one or more of the components shown in FIG. 1, one or more other components (e.g., a resistor) not shown in FIG. 1, and/or omission of one or more of the components shown in FIG. 1. The arrangement of the components of the lighting circuit 142 can vary, and there can be multiple lighting circuits 142 in the portion of the light fixture 190.

In this case, the power supply 140 includes a Buck converter 170. The Buck converter 170 in this example includes a comparator 173 with input signals from the sensor 160-1, another comparator 176 with inputs from the controller 104, multiple resistors (e.g., resistor 171, resistor 172, resistor 177), a transistor 175, and an integrated circuit (IC) 174. Resistor 171 and resistor 172 are tied to the sensor 160-1. The output of the IC 174 (also called the setting current) represents the output of the Buck converter 170 and is coupled to a switch 182, which is also coupled to the lighting circuit 142. In other words, the setting current output by the IC 174 of the Buck converter 170 drives the lighting circuit 142 (and, more specifically, the LED 186).

The controller 104 is coupled to the Buck converter 170, in this case using a resistor 178 and a capacitor 179. Specifically, the controller 104 has two pulse width modulation (PWM) outputs. The first PWM output 166 is for digital dimming and is coupled directly to the IC 174. The second PWM output 167 is for the setting current and analog dimming, and the second PWM output 167 ties directly to comparator 176. The controller 104 and the comparator 173 of the Buck converter 170 each provides an input to the IC 174 of the Buck converter 170. More details about the controller 104, the power supply 140, the lighting circuit 142, and the sensors 160 are also provided below with respect to FIG. 4. The portion of the light fixture 190 in this case is fed from a power source 189. An example of a power source 189 can be AC mains power, as fed through a wall outlet or a circuit breaker.

Often, the various discrete components (e.g., resistor 171, capacitor 185) shown in FIG. 1 are used in the portion of the light fixture 190 because they are inexpensive, keeping the overall cost of the light fixture 190 at a reasonable level for consumers. The downside of using these discrete components is that the error for the nominal value for each discrete component can be large. For example, if the nominal value of a resistor is 1.0 kΩ, but the actual value is 1.2 kΩ, this can cause problems with respect to the setting current, as shown in FIG. 2 below.

Figure 2:
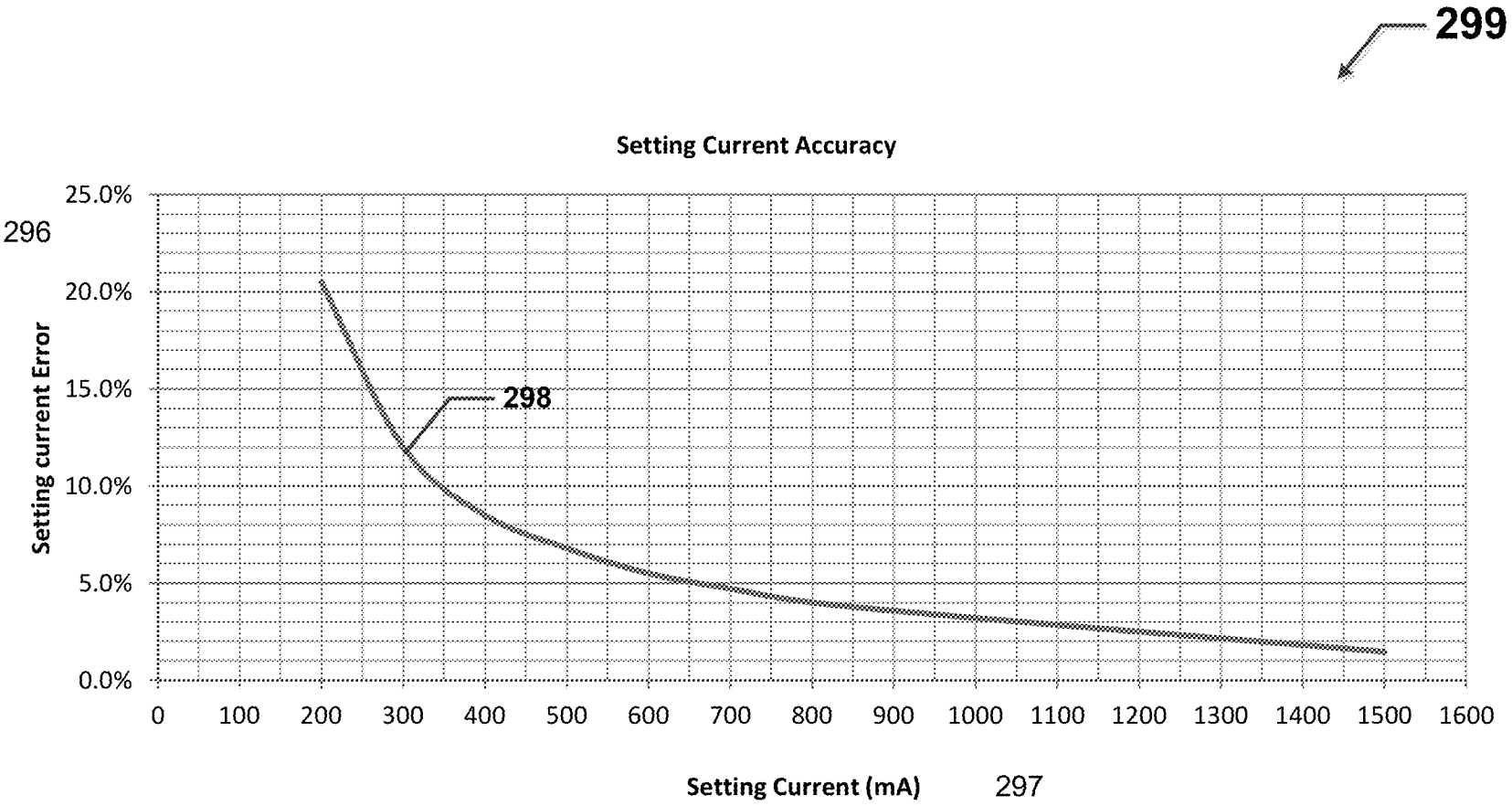
FIG. 2 (Prior Art)
FIG. 2 shows a graph of errors across a range of setting currents for lighting circuits currently used in the art.

FIG. 2 shows a graph 299 of setting current errors 296 across a range of setting currents 297 for lighting circuits currently used in the art. The setting current error 296 under applicable standards and/or acceptable practice is plus-or-minus 5%. The setting current error 296 represents, as a percentage, the difference between the setting current 297 (for example, as output at the second PWM output 167 by the controller 104 of FIG. 1) and the current received by the LEDs (e.g., LEDs 186) of a lighting circuit (e.g., lighting circuit 142) (as measured, for example, by sensor 160-2 in FIG. 1).

Unlike with example embodiments, the setting current 297 in the current art is not altered or otherwise compensated. As a result, as the curve 298 in the graph 299 of FIG. 2 shows, the setting current error 296 exceeds 5% when the setting current 297 is less than approximately 650 mA. In fact, as the setting current 297 (e.g., as output by the PWM output 167 of the controller 104 in FIG. 1) is reduced toward 200 mA (a typical minimum amount), the setting current error 296 becomes multiples worse. Specifically, as shown in the curve 298, when the setting current 297 is 200 mA, the setting current error 296 is approximately 20%. Therefore, in the current art, at somewhat lower setting currents 297 (e.g., less than 650 mA), the setting current error 296 becomes unacceptable because the difference between actual values and nominal values for the discrete components (for example, as found in the power supply 140 and the lighting circuit 142 of FIG. 1) becomes accentuated.

Figure 3:
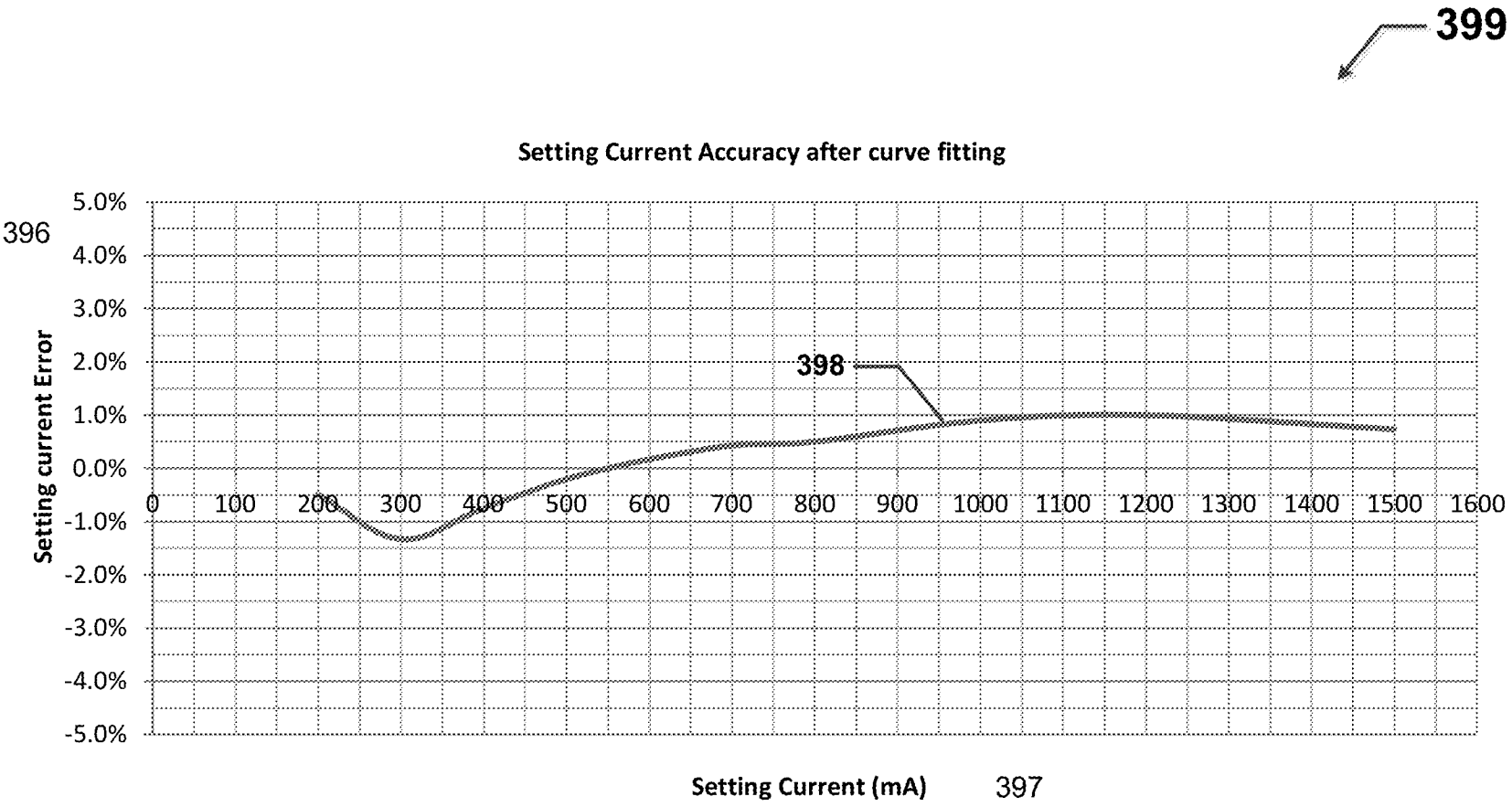
FIG. 3 shows a graph of errors across a range of setting currents for lighting circuits in accordance with certain example embodiments.

By contrast, FIG. 3 shows a graph 399 of setting current errors 396 across a range of setting currents 397 for lighting circuits in accordance with certain example embodiments. As the curve 398 in the graph 399 of FIG. 3 shows, the setting current error 396 never exceeds plus-or-minus 1.5% throughout the range of setting currents 397. In fact, when the setting current 397 (e.g., as output by the PWM output 167 of the controller 104 in FIG. 1) is toward the low end (e.g., less than 650 mA), the setting current error 396 hovers around zero. Therefore, using example embodiments, especially at lower setting currents 397 (e.g., less than 650 mA), the setting current error 396 is significantly better than the setting current errors 296 that result in the current art. Further, using example embodiments, the setting current 397 is corrected (altered), and so the setting current error 396 is always well within the maximum allowable error of plus-or-minus 5%, regardless of the setting current 397.

To get the results shown in the graph 399 of FIG. 3, the controller (e.g., controller 104) is configured to direct the power supply (e.g., power supply 140) to output a setting current 397 that is based on the actual values (rather than the nominal values) of the discrete components of the light fixture 190. Specifically, as shown in FIG. 3, by using one or more of a number of algorithms, the controller (e.g., controller 104) can create a curve, based on the actual values of the discrete components associated with the setting current 397, to minimize the setting current error 396 throughout the entire range of setting currents 397. Example embodiments can be determined on a one-time basis (e.g., during the manufacturing process, before a light fixture is sent to a customer), on a continuous basis, or periodically.

Figure 4:
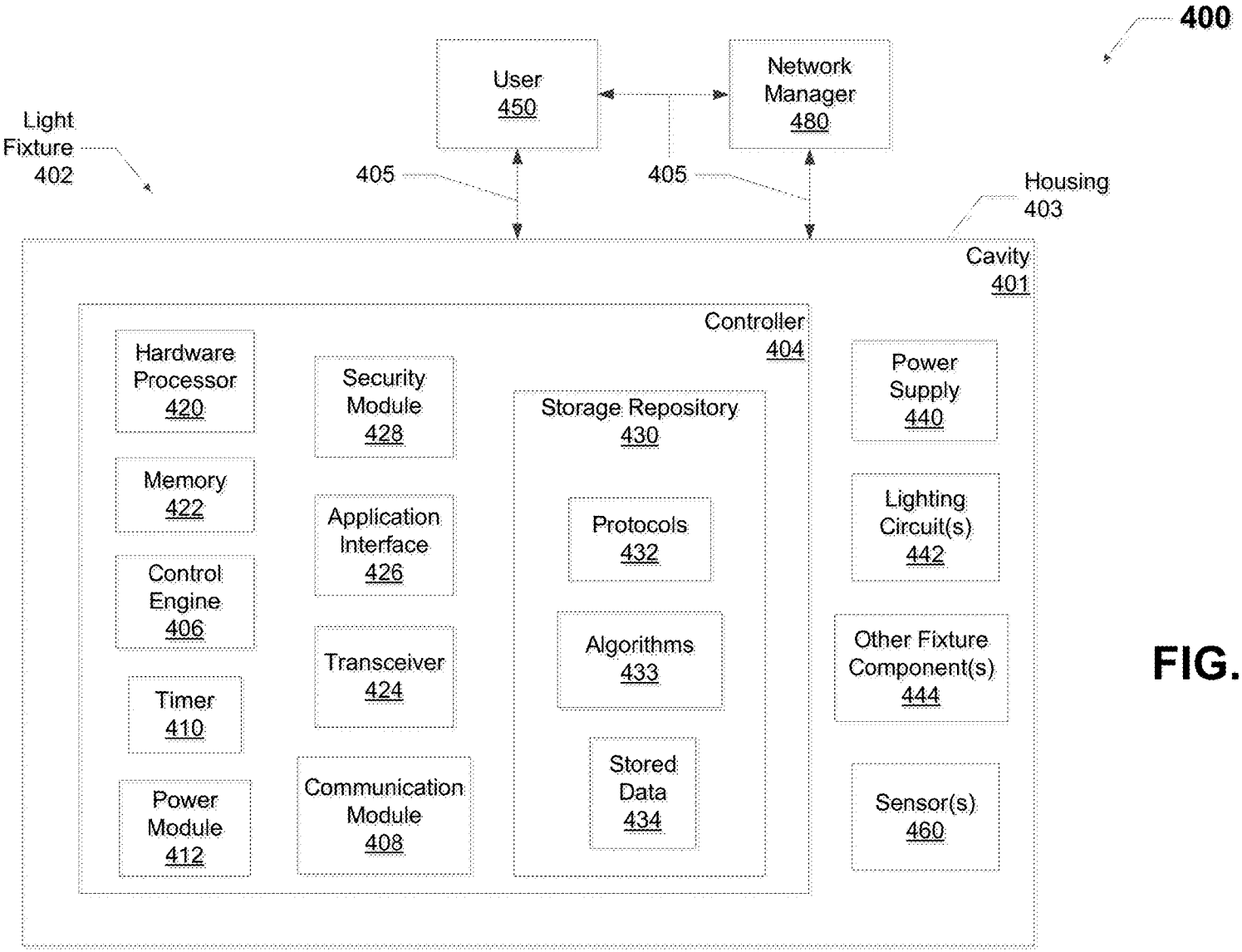
FIG. 4 shows a system diagram of a lighting system that includes a light fixture with a controller in accordance with certain example embodiments.

FIG. 4 shows a system diagram of a lighting system 400 that includes a controller 404 of a light fixture 402 in accordance with certain example embodiments. The lighting system 400 can include a user 450, a network manager 480, and the light fixture 402. In addition to the controller 404, the light fixture 402 can include a power supply 440, one or more lighting circuits 442, one or more sensors 460, and one or more other fixture components 444. The controller 404 can include one or more of a number of components. Such components, can include, but are not limited to, a control engine 406, a communication module 408, a timer 410, a power module 412, a storage repository 430, a hardware processor 420, a memory 422, a transceiver 424, an application interface 426, and, optionally, a security module 428. The components shown in FIG. 4 are not exhaustive, and in some embodiments, one or more of the components shown in FIG. 4 may not be included in an example light fixture. Any component of the example light fixture 402 can be discrete or combined with one or more other components of the light fixture 402.

A user 450 may be any person that interacts with light fixtures. Examples of a user 450 may include, but are not limited to, an engineer, an electrician, an instrumentation and controls technician, a mechanic, an operator, a property manager, a homeowner, a tenant, an employee, a consultant, a contractor, and a manufacturer's representative. The user 450 can use a user system (not shown), which may include a display (e.g., a GUI). The user 450 can interact with (e.g., sends data to, receives data from) the controller 404 of the light fixture 402 via the application interface 426 (described below). The user 450 can also interact with the network manager 480 and the rest of the light fixture 402.

Interaction between the user 450, the light fixture 402, and the network manager 480 can be conducted using communication links 405. Each communication link 405 can include wired (e.g., Class 1 electrical cables, Class 2 electrical cables, electrical connectors) and/or wireless (e.g., Wi-Fi, Zigbee, visible light communication, cellular networking, Bluetooth, WirelessHART, ISA100, Power Line Carrier, RS485, DALI) technology. The communication link 405 can transmit signals (e.g., power signals, communication signals, control signals, data) between the light fixture 402 and the user 450, and the network manager 480.

The network manager 480 is a device or component that controls all or a portion of a communication network that includes the controller 404 of the light fixture 402 and the user 450 (and, if applicable, other light fixtures in the lighting system 400). The network manager 480 can be substantially similar to the controller 404. Alternatively, the network manager 480 can include one or more of a number of features in addition to, or altered from, the features of the controller 404 described below. As described herein, communication with the network manager 480 can include communicating with one or more other components of the system 400. In such a case, the network manager 480 can facilitate such communication.

In some cases, the lighting system 400 of FIG. 4 can include one or more other light fixtures in addition to light fixture 402. In such a case, the other light fixtures can be substantially the same as the light fixture 402 described herein. One or more components of the light fixture 402 can be shared with one or more of the other light fixtures. For example, the controller 404 of the light fixture 402 can also control some or all of the other light fixtures. Further, the light fixture 402, the user 450, and/or the network manager 480 can communicate with these other light fixtures using communication links 405 in a similar manner described herein with respect to communications between the light fixture 402, the user 450, and the network manager 480.

The user 450 and the network manager 480 can interact with the controller 404 of the light fixture 402 using the application interface 426 in accordance with one or more example embodiments. Specifically, the application interface 426 of the controller 404 receives data (e.g., information, communications, instructions, updates to firmware) from and sends data (e.g., information, communications, instructions) to the user 450 and the network manager 480. The user 450 and the network manager 480 can include an interface to receive data from and send data to the controller 404 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

The controller 404, the user 450, and the network manager 480 can use their own system or share a system in certain example embodiments. Such a system can be, or contain a form of, an Internet-based or an intranet-based computer system that is capable of communicating with various software. A computer system includes any type of computing device and/or communication device, including but not limited to the controller 404. Examples of such a system can include, but are not limited to, a desktop computer with Local Area Network (LAN), Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system can correspond to a computer system as described below with regard to FIG. 5.

Further, as discussed above, such a system can have corresponding software (e.g., user software, controller software, network manager software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, LAN, WAN, or other network communication methods) and/or communication channels, with wire and/or wireless segments according to some example embodiments. The software of one system can be a part of, or operate separately but in conjunction with, the software of another system within the system 400.

The light fixture 402 can include a housing 403. The housing 403 can include at least one wall that forms a cavity 401. In some cases, the housing 403 can be designed to comply with any applicable standards so that the light fixture 402 can be located in a particular environment. The housing 403 can form any type of light fixture 402, including but not limited to a troffer light fixture, a down can light fixture, a recessed light fixture, and a pendant light fixture. The housing 403 can also be used to combine the light fixture 402 with some other device, including but not limited to a ceiling fan, a smoke detector, a broken glass detector, a garage door opener, and a wall clock.

The housing 403 of the light fixture 402 can be used to house one or more components of the light fixture 402, including one or more components of the controller 404. For example, the controller 404 (which in this case includes the control engine 406, the communication module 408, the timer 410, the power module 412, the storage repository 430, the hardware processor 420, the memory 422, the transceiver 424, the application interface 426, and the optional security module 428), one or more sensors 460, the power supply 440, the lighting circuits 442, and the other fixture components 444 can be disposed in the cavity 401 formed by the housing 403. In alternative embodiments, any one or more of these or other components (e.g., a sensor 460) of the light fixture 402 can be disposed on the housing 403 and/or remotely from the housing 403.

The storage repository 430 can be a persistent storage device (or set of devices) that stores software and data used to assist the controller 404 in communicating with the user 450 and the network manager 480 (as well as other light fixtures, if any) within the system 400. In one or more example embodiments, the storage repository 430 stores one or more protocols 432, algorithms 433, and stored data 434. The protocols 432 can include any processes or logic steps that are implemented by the control engine 406 based on certain conditions at a point in time.

The protocols 432 can include communication protocols that are used to send and/or receive data between the controller 404, the user 450, and the network manager 480. One or more of the protocols 432 can be a time-synchronized protocol for communications. Examples of such time-synchronized protocols can include, but are not limited to, a highway addressable remote transducer (HART) protocol, a wirelessHART protocol, and an International Society of Automation (ISA) 100 protocol. In this way, one or more of the protocols 432 can provide a layer of security to the data transferred within the system 400.

The algorithms 433 can be any models, formulas, and/or other similar operational implementations that the control engine 406 of the controller 404 uses. An algorithm 433 can at times be used in conjunction with a protocol 432. An example of a protocol 432 is measuring, using a sensor 460 (for example, the sensor 160-2 in FIG. 1), an actual current flowing to the light sources (e.g., LEDs 186 of FIG. 1) of the lighting circuit 442 (e.g., the lighting circuit 142 of FIG. 1) based on a known setting current (e.g., setting current 397) delivered by the control engine 406 of the controller 404 (e.g., controller 104 using a PWM output 167 of FIG. 1). Another example of a protocol 432 is to repeat this process multiple times, each time at a different known setting current.

For example, an algorithm 433 can be used to establish a linear equation to correct for the setting current error (e.g., setting current error 396) based on actual values of the various applicable discrete components of the light fixture 402. An example of such a linear equation can be: Measured current=(delivered setting current×X)+Y, where X is a calculated slope of the linear equation, Y is a calculated intercept of the linear equation, the measured current is the actual current flowing to the light sources (e.g., LEDs 186 of FIG. 1) of the lighting circuit 442 (e.g., the lighting circuit 142 of FIG. 1) as measured by a sensor 460 (for example, the sensor 160-2 in FIG. 1), and the delivered setting current (e.g., setting current 397) is delivered by the control engine 406 of the controller 404 (e.g., controller 104 using a PWM output 167 of FIG. 1).

A protocol 432 used to calculate the X and Y values of the above equation can dictate that two or more different measurements are taken of the current delivered to the light sources for a given setting current 397 delivered by the controller 404. For example, one measurement by a sensor 460 of can be of the actual current flowing to the light sources (e.g., LEDs 186 of FIG. 1) of the lighting circuit 442 (e.g., the lighting circuit 142 of FIG. 1) as measured by a sensor 460 (for example, the sensor 160-2 in FIG. 1) based on a known setting current of 200 mA output by the controller 404.

Continuing with the same example, another measurement by a sensor 460 of can be of the actual current flowing to the light sources of the lighting circuit 442 as measured by a sensor 460 based on a known setting current of 500 mA output by the controller 404. As a result, solving the algebra presented by the algorithm results in the following: X=[(measured current for a delivered setting current of 500 mA)−(measured current for a delivered setting current of 200 mA)]±300, and Y=[5/3×(measured current for a delivered setting current of 200 mA)]−[⅔×(measured current for a delivered setting current of 500 mA)].

The results of this algorithm can then be applied to all setting currents delivered by the controller 404 across the range of setting currents. Specifically, the control engine 406 of the controller 404 sends a setting current control signal (for example, using the PWM output 167 of FIG. 1) to the power supply 440, where the setting current control signal adjusts the setting current provided by the power supply 440 to the lighting circuit 442. For example, if the setting current that needs to flow through the light sources of the lighting circuit 442 is 800 mA, then the controller 404 delivers a setting current control signal to the power supply 440, where the setting current control signal instructs the power supply 440 to adjust the setting current delivered to the lighting circuit 442 so that the setting current is equal to (800 mA−Y)÷X. As a result of the controller 404 using this correction factor that results from the algorithm, and sending the resulting setting current correction signal to the power supply 440, the setting current error caused by the imprecision of the relevant discrete devices in the power supply 440 and the lighting circuit 442 is minimized, if not eliminated, as shown by the graph 399 of FIG. 3 above.

Such a linear equation or other algorithm 433 can be developed in any of a number of ways. For example, the linear equation or other algorithm 433 can be developed after testing multiple light fixtures having a similar configuration (e.g., similar power supply 440, similar lighting circuit 442, similar controller 404). Any subsequent improvements to a linear equation or other algorithm 433 that can further reduce the setting current error for the light fixture 402 can be uploaded (e.g., manually by a user 450, by the network manager 480 using the transceiver 424) to the controller 404 to replace the prior linear equation or other algorithm 433. Similarly, the control engine 406 of the controller 404 can track the performance of a currently-used linear equation or other algorithm 433 and make its own improvements in order to further reduce the setting current error.

As another example of an operational protocol 433, the controller 404, after establishing the setting current corrections for a range of setting currents, can be directed to store the setting current corrections into the storage repository 430 as stored data 434. As yet another example of an operational protocol 433, configurations of the controller 404 can be stored in memory 422 (e.g., non-volatile memory) so that the controller 404 (or portions thereof) can operate regardless of whether the controller 404 is communicating with the network manager 480 and/or the user 450 in the system 400. Still another example of an operational protocol 433 can be for the controller 404 operate in an autonomous control mode if one or more components (e.g., the communication module 408, the transceiver 424) of the controller 404 that allows the controller 404 to communicate with another component of the system 400 fails.

Stored data 434 can be any historical, present, and/or forecast data. Stored data 134 can be associated with a sensor 460, the lighting circuit 442, the power supply 440, the controller 404, any of the other fixture components 444, the network manager 480, and a user 450. Such stored data 434 can include, but are not limited to, settings, default values, user preferences, results of an algorithm, capabilities of a light source, nominal values of discrete components of the power supply 440 and the lighting circuit 442, a manufacturer of a sensor 460, a model number of a sensor 460, and measurements taken by the sensor 460.

Examples of a storage repository 430 can include, but are not limited to, a database (or a number of databases), a file system, a hard drive, flash memory, some other form of solid state data storage, or any suitable combination thereof. The storage repository 430 can be located on multiple physical machines, each storing all or a portion of the protocols 432, the algorithms 433, and/or the stored data 434 according to some example embodiments. Each storage unit or device of the storage repository 430 can be physically located in the same or in a different geographic location.

The storage repository 430 can be operatively connected to the control engine 406. In one or more example embodiments, the control engine 406 includes functionality to communicate with the user 450 and the network manager 480. More specifically, the control engine 406 sends information to and/or receives information from the storage repository 430 in order to communicate with the user 450 and the network manager 480. As discussed below, the storage repository 430 can also be operatively connected to the communication module 408 in certain example embodiments.

In certain example embodiments, the control engine 406 of the controller 404 controls the operation of one or more components (e.g., the communication module 408, the timer 410, the transceiver 424) of the controller 404. For example, the control engine 406 can activate the communication module 408 when the communication module 408 is in "sleep" mode and when the communication module 408 is needed to send data received from another component (e.g., a sensor 460, the user 450) in the system 400. As another example, the control engine 406 can operate one or more sensors 460 to dictate when measurements are taken by the sensors 460 and when those measurements are communicated by the sensors 460 to the control engine 406. As another example, the control engine 406 can acquire the current time using the timer 410. The timer 410 can enable the controller 404 to control the light fixture 402 even when the controller 404 has no communication with the network manager 480.

As another example, the control engine 406 can store configurations of the controller 404 (or portions thereof) in memory 422 (e.g., non-volatile memory) so that the controller 404 (or portions thereof) can operate regardless of whether the controller 404 is communicating with the network controller 480 and/or other components in the system 400. As still another example, conduct one or more tests, according to a protocol 432 and/or an algorithm 433, to compare a setting current delivered by the controller 404 with a current, measured by a sensor 460 (e.g., sensor 160-2) flowing to the light sources (e.g., light sources 186) of the lighting circuit 442.

As a result, the control engine 406 can obtain measurements from a sensor 460 and use those measurements to create adjustments to a setting current (e.g., setting current 397) delivered to a lighting circuit 442 in order to minimize the setting current error 396. Specifically, the controller 404 sends a setting current control signal (for example, using the PWM output 167 of FIG. 1) to the power supply 440, where the setting current control signal adjusts the setting current provided by the power supply 440 to the light sources of the lighting circuit 442 based on the setting current correction curve generated by the control engine 406 using the protocols 432 and/or the algorithms 433, as described above.

If the sensor 460 used to take these current measurements is temporary (e.g., used at the end of the manufacturing process and before the light fixture 402 is sent to a distributor or customer, used during the installation process by an electrician), then the sensor 460 is used for the specific purpose of creating a setting current correction curve using one or more protocols 432 and/or algorithms 433.

In some cases, the sensor 460 used to measure actual current flowing through the light sources of the lighting circuit 442 can be a permanent component of the light fixture 402. In such a case, the control engine 406 of the controller 404 can use the sensor 460 to take measurements continuously or periodically so that the control engine 406 can continuously or periodically evaluate and adjust the setting current correction curve based on changing characteristics (e.g., after the power supply 440 or portion thereof is repaired and/or replaced) of the light fixture 402 over time.

As yet another example, the control engine 406 can control (e.g., create adjustments to a setting current) at least other light fixture based on specific data collected from that particular light fixture. To accomplish this, for example, the network manager 480 can instruct, upon a request from the control engine 406, a sensor of another light fixture to communicate its readings to the control engine 406 of the controller 404 of the light fixture 402 using communication links 405. As still another example, the control engine 406 can cause the controller 404 to operate in an autonomous control mode if one or more components (e.g., the communication module 408, the transceiver 424) of the controller 404 that allows the controller 404 to communicate with another component of the system 400 fails.

In certain example embodiments, the control engine 406 of the controller 404 is aware of and/or drives the determination as to the setting current that should flow through the light sources of the lighting circuit 442. For example, when receiving signals from a user 450 through a dimmer switch, the control engine 406 of the controller 404 can determine the level of the target (desired) setting current. As another example, in communicating with the power supply 440, the control engine 406 of the controller 404 can determine the level of the target (desired) setting current. In any case, when the control engine 406 of the controller 404 knows the level of the target setting current, then the control engine 406 can apply the appropriate setting current correction signal to the power supply 440, resulting in an altered setting current flowing through the light sources of the lighting circuit 442 that is at an appropriate level, resulting in minimal setting current error.

The setting current provided to light sources of the lighting circuit 442 can have a range. For example, as shown in FIGS. 2 and 3 above, the setting current can have a range of 200 mA to 1500 mA. Because the setting current error using example embodiments is so low, particularly at lower setting current levels, certain types of dimming (e.g., constant current reduction (CCR)) can have an even lower range (e.g., 100 mA or less) of setting currents and still have minimal to no error.

The control engine 406 can provide control, communication, and/or other similar signals to the user 450 and the network manager 480. Similarly, the control engine 406 can receive control, communication, and/or other similar signals from the user 450 and the network manager 480. The control engine 406 can control each sensor 460 automatically (for example, based on one or more protocols 432 and/or algorithms 433 stored in the storage repository 430) and/or based on control, communication, and/or other similar signals received from another component (e.g., the network manager 480) through a communication link 405. The control engine 406 may include a printed circuit board, upon which the hardware processor 420 and/or one or more discrete components of the controller 404 are positioned.

In certain example embodiments, the control engine 406 can include an interface that enables the control engine 406 to communicate with one or more components (e.g., power supply 440) of the light fixture 402. For example, if the power supply 440 of the light fixture 402 operates under IEC Standard 62386, then the power supply 440 can include a digital addressable lighting interface (DALI). In such a case, the control engine 406 can also include a DALI to enable communication with the power supply 440 within the light fixture 402. Such an interface can operate in conjunction with, or independently of, the protocols 432 used to communicate between the controller 404, the user 450, and the network manager 480.

The control engine 406 (or other components of the controller 404) can also include one or more hardware components and/or software elements to perform its functions. Such components can include, but are not limited to, a universal asynchronous receiver/transmitter (UART), a serial peripheral interface (SPI), a direct-attached capacity (DAC) storage device, an analog-to-digital converter, an inter-integrated circuit ($I^2C$), and a pulse width modulator (PWM).

The communication module 408 of the controller 404 determines and implements the communication protocol (e.g., from the protocols 432 of the storage repository 430) that is used when the control engine 406 communicates with (e.g., sends signals to, receives signals from) the user 450, the network manager 480, and/or one or more of the sensors 460. In some cases, the communication module 408 accesses the stored data 434 to determine which protocol 432 is used to communicate with the sensor 460 associated with the stored data 434. In addition, the communication module 408 can interpret the protocol 432 of a communication received by the controller 404 so that the control engine 406 can interpret the communication.

The communication module 408 can send and receive data between the network manager 480, the users 450, and the controller 404. The communication module 408 can send and/or receive data in a given format that follows a particular protocol 432 for communication. The control engine 406 can interpret the data packet received from the communication module 408 using information about a protocol 432 stored in the storage repository 430. The control engine 406 can also facilitate the data transfer between with the network manager 480 and/or a user 450 by converting the data into a format understood by the communication module 408.

The communication module 408 can send data (e.g., protocols 432, algorithms 433, stored data 434, measurements made by a sensor 460, operational information, error codes, threshold values, user preferences) directly to and/or retrieve data directly from the storage repository 430. Alternatively, the control engine 406 can facilitate the transfer of data between the communication module 408 and the storage repository 430. The communication module 408 can also provide encryption to data that is sent by the controller 404 and decryption to data that is received by the controller 404. The communication module 408 can also provide one or more of a number of other services with respect to data sent from and received by the controller 404. Such services can include, but are not limited to, data packet routing information and procedures to follow in the event of data interruption.

The timer 410 of the controller 404 can track clock time, intervals of time, an amount of time, and/or any other measure of time. The timer 410 can also count the number of occurrences of an event, whether with or without respect to time. Alternatively, the control engine 406 can perform the counting function. The timer 410 is able to track multiple time measurements concurrently. The timer 410 can track time periods based on an instruction received from the control engine 406, based on an instruction received from the user 450, based on an instruction programmed in the software for the controller 404, based on some other condition or from some other component, or from any combination thereof.

The timer 410 can be configured to track time when there is no power delivered to the controller 404 (e.g., the power module 412 malfunctions) using, for example, a super capacitor or a battery backup. In such a case, when there is a resumption of power delivery to the controller 404, the timer 410 can communicate any aspect of time to the controller 404. In such a case, the timer 410 can include one or more of a number of components (e.g., a super capacitor, an integrated circuit) to perform these functions.

The power module 412 of the controller 404 provides power to one or more other components (e.g., timer 410, control engine 406) of the controller 404. In addition, in certain example embodiments, the power module 412 can provide power (e.g., secondary power) to the power supply 440 of the light fixture 402. The power module 412 can include one or more of a number of single or multiple discrete components (e.g., transistor, diode, resistor), and/or a microprocessor. The power module 412 may include a printed circuit board, upon which the microprocessor and/or one or more discrete components are positioned. In some cases, the power module 412 can include one or more components that allow the power module 412 to measure one or more elements of power (e.g., voltage, current) that is delivered to and/or sent from the power module 412.

The power module 412 can include one or more components (e.g., a transformer, a diode bridge, an inverter, a converter) that receives power (for example, through an electrical cable) from the power supply 440 and/or a source external to the light fixture 402. The power module 412 can use this power to generate power of a type (e.g., alternating current, direct current) and level (e.g., 12V, 24V, 120V) that can be used by the other components of the controller 404. In addition, or in the alternative, the power module 412 can be a source of power in itself to provide signals to the other components of the controller 404 and/or the power supply 440. For example, the power module 412 can include a battery or other form of energy storage device. As another example, the power module 412 can include a localized photovoltaic solar power system.

In certain example embodiments, the power module 412 of the controller 404 can also provide power and/or control signals, directly or indirectly, to one or more of the sensors 460. In such a case, the control engine 406 can direct the power generated by the power module 412 to the sensors 460 and/or the power supply 440 of the light fixture 402. In this way, power can be conserved by sending power to the sensors 460 and/or the power supply 440 of the light fixture 402 when those devices need power, as determined by the control engine 406.

The hardware processor 420 of the controller 404 executes software, algorithms (e.g., algorithms 433), and firmware in accordance with one or more example embodiments. Specifically, the hardware processor 420 can execute software on the control engine 406 or any other portion of the controller 404, as well as software used by the user 450 and the network manager 480. The hardware processor 420 can be or include an integrated circuit (IC), a central processing unit, a multi-core processing chip, SoC, a multi-chip module including multiple multi-core processing chips, or other hardware processor in one or more example embodiments. The hardware processor 420 can be known by other names, including but not limited to a computer processor, a microprocessor, and a multi-core processor.

In one or more example embodiments, the hardware processor 420 executes software instructions stored in memory 422. The memory 422 includes one or more cache memories, main memory, and/or any other suitable type of memory. The memory 422 can include volatile and/or non-volatile memory. The memory 422 is discretely located within the controller 404 relative to the hardware processor 420 according to some example embodiments. In certain configurations, the memory 422 can be integrated with the hardware processor 420.

In certain example embodiments, the controller 404 does not include a hardware processor 420. In such a case, the controller 404 can include, as an example, one or more field programmable gate arrays (FPGA), one or more insulated-gate bipolar transistors (IGBTs), and/or one or more ICs. Using FPGAs, IGBTs, ICs, and/or other similar devices known in the art allows the controller 404 (or portions thereof) to be programmable and function according to certain logic rules and thresholds without the use of a hardware processor. Alternatively, FPGAs, IGBTs, ICs, and/or similar devices can be used in conjunction with one or more hardware processors 420.

The transceiver 424 of the controller 404 can send and/or receive control and/or communication signals. Specifically, the transceiver 424 can be used to transfer data between the controller 404, the user 450, and the network manager 480. The transceiver 424 can use wired and/or wireless technology. The transceiver 424 can be configured in such a way that the control and/or communication signals sent and/or received by the transceiver 424 can be received and/or sent by another transceiver that is part of the user 450 and the network manager 480. The transceiver 424 can use any of a number of signal types, including but not limited to radio frequency signals and visible light signals.

When the transceiver 424 uses wireless technology, any type of wireless technology can be used by the transceiver 424 in sending and receiving signals. Such wireless technology can include, but is not limited to, Wi-Fi, Zigbee, visible light communication, cellular networking, Bluetooth, and Bluetooth Low Energy. The transceiver 424 can use one or more of any number of suitable protocols 432 (e.g., ISA100, HART) when sending and/or receiving signals. Such communication protocols can be stored in the protocols 432 of the storage repository 430. Further, any transceiver information for the user 450 and the network manager 480 can be part of the protocols 432 (or other areas) of the storage repository 430.

Optionally, in one or more example embodiments, the security module 428 secures interactions between the controller 404, the user 450, and the network manager 480. More specifically, the security module 428 authenticates communication from software based on security keys verifying the identity of the source of the communication. For example, user software may be associated with a security key enabling the software of the user 450 to interact with the controller 404. Further, the security module 428 can restrict receipt of information, requests for information, and/or access to information in some example embodiments.

As mentioned above, aside from the controller 404 and its components, the light fixture 402 can include one or more sensors 460, a power supply 440, and one or more lighting circuits 442. The lighting circuits 442 of the light fixture 402 are devices and/or components typically found in a light fixture to allow the light fixture 402 to operate (emit light). An example of a lighting circuit 442 can be found with respect to the lighting circuit 142 of FIG. 1 above. For example, a lighting circuit 442 can include one or more light sources (e.g., light sources 186) that emit light using power provided by the power supply 440. The light fixture 402 can have one or more of any number and/or type (e.g., light-emitting diode, incandescent, fluorescent, halogen) of light sources in a lighting circuit 442. A lighting circuit 442 can vary in the amount and/or color of light that it emits.

The power supply 440 of the light fixture 402 receives power from an external source (e.g., a wall outlet, a circuit breaker, an energy storage device). The power supply 440 uses the power it receives to generate and provide power to the power module 412 of the controller 404, the sensors 460, and/or one or more of the lighting circuits 442. The power supply 440 can be called by any of a number of other names, including but not limited to a driver, a LED driver, and a ballast. The power supply 440 can include one or more of a number of single or multiple discrete components (e.g., transistor, diode, resistor), and/or a microprocessor. The power supply 440 may include a printed circuit board, upon which the microprocessor and/or one or more discrete components are positioned, and/or a dimmer.

In some cases, the power supply 440 can include one or more components (e.g., a transformer, a diode bridge, an inverter, a converter) that receives power (for example, through an electrical cable) from the power module 412 of the controller 404 and generates power of a type (e.g., alternating current, direct current) and level (e.g., 12V, 24V, 120V) that can be used by sensors 460 and/or the lighting circuits 442. In addition, or in the alternative, the power supply 440 can be a source of power in itself. For example, the power supply 440 can or include be a battery, a localized photovoltaic solar power system, or some other source of independent power. An example of a power supply 440 (or portion thereof) is provided above with respect to the power supply 140 of FIG. 1.

The one or more optional other fixture components 444 can include any of a number of components that are part of a light fixture, such as light fixture 402. Such other fixture components 444 can be electrical, electronic, mechanical, or some combination thereof. Example of such other fixture components 444 can include, but are not limited to, a reflector, a refractor, a baffle, a wave guide, a heat sink, an electrical conductor or electrical cable, a terminal block, a diffuser, an air moving device, a circuit board, an energy storage device (e.g., a battery) and a lens.

The one or more sensors 460 measure one or more parameters (e.g., current, pressure, temperature, carbon monoxide, ambient temperature, humidity, voltage). An example of a sensor 460 is provided above with respect to the sensor 460 of FIG. 1. The one or more sensors 460 can be any type of sensing device that measure one or more parameters. Examples of types of sensors 460 can include, but are not limited to, a resistor, a passive infrared sensor, a photocell, a differential pressure sensor, a humidity sensor, a pressure sensor, an air flow monitor, a gas detector, and a resistance temperature detector. The light fixture 402 can include one or more sensors 460 that are used to directly operate the light fixture 402. Each sensor 460 can use one or more of a number of protocols 432 for operations and/or communication.

As stated above, the light fixture 402 can be placed in any of a number of environments. In such a case, the housing 403 of the light fixture 402 can be configured to comply with applicable standards for any of a number of environments. For example, the light fixture 402 can be rated as a Division 1 or a Division 2 enclosure under NEC standards. Similarly, any of the sensors 460 or other devices communicably coupled to the light fixture 402 can be configured to comply with applicable standards for any of a number of environments. For example, the housing 403 can be rated as a Division 1 or a Division 2 enclosure under NEC standards.

Figure 5:
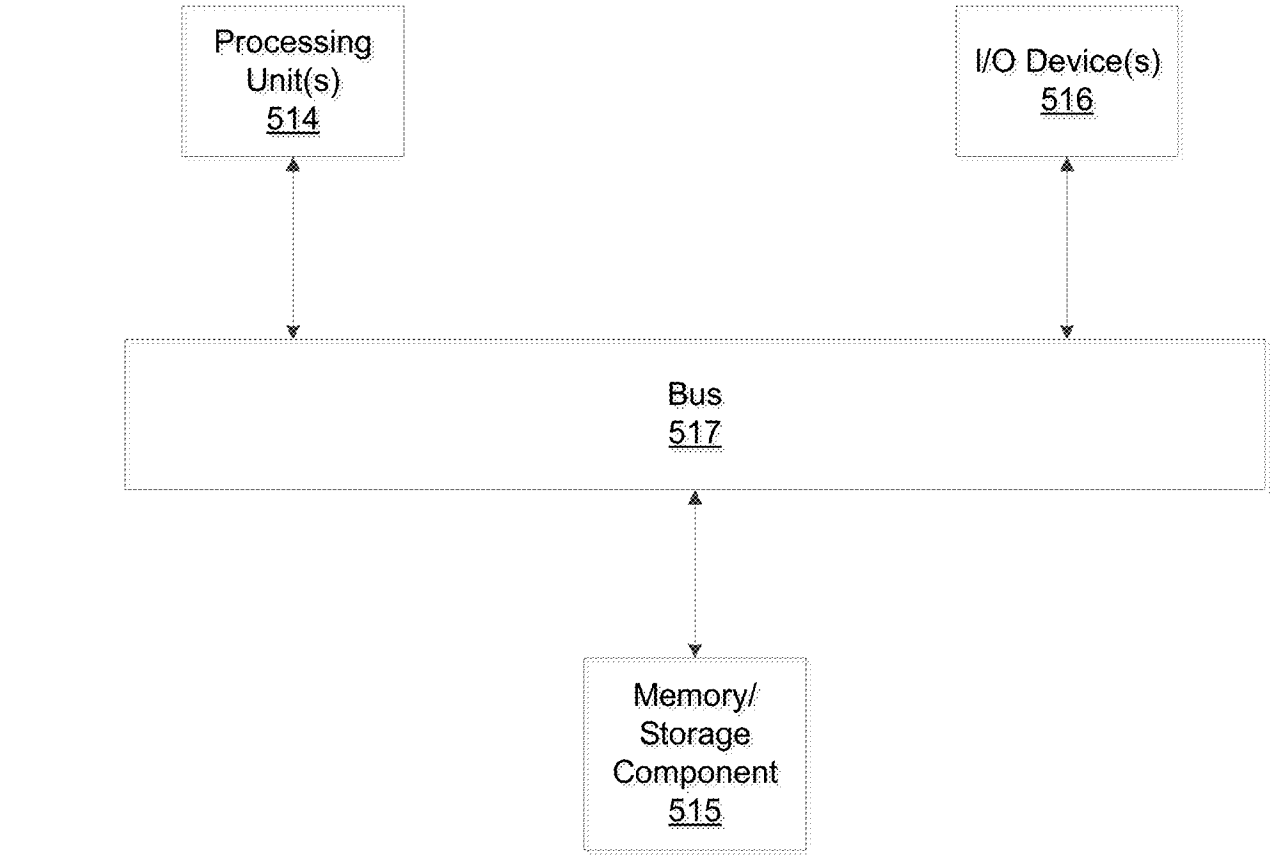
FIG. 5 shows a computing device in accordance with certain example embodiments.

FIG. 5 illustrates one embodiment of a computing device 518 that implements one or more of the various techniques described herein, and which is representative, in whole or in part, of the elements described herein pursuant to certain example embodiments. For example, computing device 518 can be implemented in the light fixture 402 of FIG. 4 in the form of the hardware processor 420, the memory 422, and the storage repository 430, among other components. Computing device 518 is one example of a computing device and is not intended to suggest any limitation as to scope of use or functionality of the computing device and/or its possible architectures. Neither should computing device 518 be interpreted as having any dependency or requirement relating to any one or combination of components illustrated in the example computing device 518.

Computing device 518 includes one or more processors or processing units 514, one or more memory/storage components 515, one or more input/output (I/O) devices 516, and a bus 517 that allows the various components and devices to communicate with one another. Bus 517 represents one or more of any of several types of bus structures, including a memory bus or memory controller, a peripheral bus, an accelerated graphics port, and a processor or local bus using any of a variety of bus architectures. Bus 517 includes wired and/or wireless buses.

Memory/storage component 515 represents one or more computer storage media. Memory/storage component 515 includes volatile media (such as random access memory (RAM)) and/or nonvolatile media (such as read only memory (ROM), flash memory, optical disks, magnetic disks, and so forth). Memory/storage component 515 includes fixed media (e.g., RAM, ROM, a fixed hard drive, etc.) as well as removable media (e.g., a Flash memory drive, a removable hard drive, an optical disk, and so forth).

One or more I/O devices 516 allow a customer, utility, or other user to enter commands and information to computing device 518, and also allow information to be presented to the customer, utility, or other user and/or other components or devices. Examples of input devices include, but are not limited to, a keyboard, a cursor control device (e.g., a mouse), a microphone, a touchscreen, and a scanner.

Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 518 is connected to a network (not shown) (e.g., a LAN, a WAN such as the Internet, cloud, or any other similar type of network) via a network interface connection (not shown) according to some example embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other example embodiments. Generally speaking, the computer system 518 includes at least the minimal processing, input, and/or output means necessary to practice one or more embodiments.

Further, those skilled in the art will appreciate that one or more elements of the aforementioned computer device 518 is located at a remote location and connected to the other elements over a network in certain example embodiments. Further, one or more embodiments is implemented on a distributed system having one or more nodes, where each portion of the implementation (e.g., control engine 406) is located on a different node within the distributed system. In one or more embodiments, the node corresponds to a computer system. Alternatively, the node corresponds to a processor with associated physical memory in some example embodiments. The node alternatively corresponds to a processor with shared memory and/or resources in some example embodiments.

Example embodiments provide a number of benefits. Such benefits can include, but are not limited to, increased reliability of the light fixture, improved efficiency of the light fixture, optimal light emitted by the light sources of the light fixture, ease of maintenance, and compliance with industry standards that apply to light fixtures. Specifically, example embodiments provide for greatly reduced or eliminated setting current error for setting currents flowing through the light sources of the light fixture. As a result, example embodiments can allow for even lower setting current levels (e.g., 100 mA) compared to what is available in the current art.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A light fixture, comprising:

at least one light source;

at least one discrete component, wherein each of the at least one discrete component has an actual value within a range of error relative to a nominal value;

a power supply coupled to the at least one light source, wherein the power supply comprises a feedback circuit and a current generator, wherein the current generator of the power supply provides a setting current to the at least one light source;

a sensor that takes a plurality of measurements of a plurality of setting currents flowing to the at least one light source; and a controller coupled to the feedback circuit, the current generator, and the sensor, wherein the controller:

receives the plurality of measurements made by the sensor, wherein each measurement of the plurality of measurements corresponds to an unaltered setting current generated by the power supply;

evaluates the plurality of measurements relative to the corresponding unaltered setting currents;

generates a setting current correction curve based on evaluating the plurality of measurements relative to the corresponding unaltered setting currents;

determines, in real time and based on the setting current correction curve, an altered setting current level; and provides, in real time, a setting current correction signal to the feedback circuit of the power supply, wherein the power supply generates and delivers, based on the setting current correction signal, the altered setting current level to the at least one light source, wherein the altered setting current level is substantially the same as a target setting current, wherein the setting current correction curve corrects for the actual value of the at least one discrete component.

2. The light fixture of claim 1, wherein the setting current correction signal is derived from the setting current correction curve covering a range of setting currents.

3. The light fixture of claim 2, wherein the range of setting currents is between 200 mA and 1500 mA.

4. The light fixture of claim 2, wherein the setting current correction curve is generated before the light fixture is put into service.

5. The light fixture of claim 4, wherein the sensor is removed after the setting current correction curve is generated and before the light fixture is put into service.

6. The light fixture of claim 4, wherein the setting current correction curve is updated while the light fixture is in service.

7. The light fixture of claim 1, wherein the setting current correction signal is established by the controller and sent to the power supply in real time.

8. The light fixture of claim 1, wherein the setting current correction curve is generated utilizing a linear equation.

9. The light fixture of claim 8, wherein the linear equation is solved for a slope and an intercept utilizing at least two measured setting currents, as measured by the sensor, delivered to the at least one light source compared to at least two of the corresponding unaltered setting currents generated by the power supply.

10. The light fixture of claim 8, wherein the linear equation is developed based on testing a plurality of other light fixtures each having a configuration that is substantially the same as the configuration of the at least one light source, the at least one discrete component, the power supply, and the controller.

11. The light fixture of claim 1, wherein the controller comprises a hardware processor and memory.

12. The light fixture of claim 1, wherein the setting current correction signal results in an error that is less than plus-or-minus two percent across the range of setting currents.

13. The light fixture of claim 1, wherein the at least one discrete component comprises at least one resistor.

14. A controller for a light fixture, the controller comprising:

a control engine configured to:

receive notification as to a target setting current to flow through at least one light source of the light fixture;

receive a plurality of measurements made by a sensor, wherein each measurement of the plurality of measurements corresponds to an unaltered setting current generated by a power supply;

evaluate the plurality of measurements relative to the corresponding unaltered setting currents;

generate a setting current correction curve based on evaluating the plurality of measurements relative to the corresponding unaltered setting currents;

determine, in real time and based on the setting current correction curve, an altered setting current level; and send, in real time, a setting current correction signal to a power supply, wherein the power supply generates and delivers, based on the setting current correction signal, the altered setting current level to the at least one light source, wherein the altered setting current level is substantially the same as the target setting current, wherein the setting current correction curve corrects for actual values of discrete components of the light fixture.

15. The controller of claim 14, wherein each unaltered setting current is driven by the control engine.

16. The controller of claim 14, wherein the control engine is further configured to:

revise the setting current correction curve based on changes to the actual values of the discrete components.

17. The controller of claim 14, further comprising:

a storage repository that stores at least one algorithm, wherein the control engine uses the at least one algorithm to generate the setting current correction curve.

18. The controller of claim 17, wherein the at least one algorithm comprises a linear equation.

19. A light fixture, comprising:

at least one light source;

at least one discrete component, wherein each of the at least one discrete component has an actual value within a range of error relative to a nominal value;

a power supply coupled to the at least one light source, wherein the power supply comprises a feedback circuit and a current generator, wherein the current generator of the power supply provides a setting current to the at least one light source;

a sensor that measures the setting current flowing to the at least one light source; and a controller coupled to the feedback circuit, the current generator, and the sensor, wherein the controller provides, in real time, a setting current correction signal to the feedback circuit of the power supply to adjust the setting current delivered by the current generator to the at least one light source, wherein the setting current correction signal is calibrated to the actual value of the at least one discrete component, wherein the setting current correction signal is derived from a setting current correction curve generated using measurements made by the sensor relative to corresponding unaltered setting currents generated by the power supply, wherein the setting current correction curve is generated before the light fixture is put into service, and wherein the sensor is removed after the setting current correction curve is generated and before the light fixture is put into service.

* * * * *